US009702275B2

(12) United States Patent
Pagliaro et al.

(10) Patent No.: US 9,702,275 B2
(45) Date of Patent: Jul. 11, 2017

(54) TIMING DRIVE OF AN INTERNAL COMBUSTION ENGINE

(71) Applicant: GM GLOBAL TECHNOLOGY OPERATIONS LLC, Detroit, MI (US)

(72) Inventors: Pierluigi Pagliaro, Turin (IT); Antonino Conti, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 14/614,059

(22) Filed: Feb. 4, 2015

(65) Prior Publication Data

US 2015/0219021 A1 Aug. 6, 2015

(30) Foreign Application Priority Data

Feb. 5, 2014 (GB) ..... 1401940.0

(51) Int. Cl.
*F01L 1/02* (2006.01)
*F01L 1/047* (2006.01)
*F02M 26/05* (2016.01)

(52) U.S. Cl.
CPC ..... *F01L 1/047* (2013.01); *F02M 26/05* (2016.02)

(58) Field of Classification Search
CPC ..... F02D 13/0203; F01L 1/047
See application file for complete search history.

(56) References Cited

U.S. PATENT DOCUMENTS

| | | | | |
|---|---|---|---|---|
| 4,563,985 | A | 1/1986 | Dorsch et al. | |
| 5,598,630 | A | 2/1997 | Savoyard et al. | |
| 5,740,773 | A | 4/1998 | Ohshige | |
| 6,332,441 | B1 | 12/2001 | Sugiyama et al. | |
| 2006/0130797 | A1 * | 6/2006 | Klotz | F01L 1/02 123/192.2 |

FOREIGN PATENT DOCUMENTS

| | | | | |
|---|---|---|---|---|
| DE | 102004043341 | A1 | 11/2005 | |
| DE | 202004014642 | U1 | 2/2006 | |
| DE | 102005023162 | A1 * | 3/2006 | F01L 1/022 |
| EP | 1469167 | A1 | 10/2004 | |
| GB | 1474672 | | 5/1977 | |
| JP | 61258909 | A | 11/1986 | |
| JP | 2010096105 | A | 4/2010 | |

OTHER PUBLICATIONS

UKIPO, British search Report for British Application No. 1401940.0, dated Aug. 18, 2014.

* cited by examiner

*Primary Examiner* — Zelalem Eshete
(74) *Attorney, Agent, or Firm* — Lorenz & Kopf LLP

(57) ABSTRACT

A timing drive is disclosed for coupling the crankshaft to the first camshaft of an internal combustion engine. The timing drive includes a first mechanical transmission coupling the engine crankshaft to an intermediate shaft located in a cylinder block, and a second mechanical transmission coupling the intermediate shaft to the first camshaft. A second camshaft may be operably coupled to the first camshaft through a mechanical transmission coupling.

19 Claims, 2 Drawing Sheets

2/2
720
130
135'
700
120
705
145
135
720
710
119
715
118
605
600
135
540
530
520
535
505
510
119
525
515
500

TIMING DRIVE OF AN INTERNAL COMBUSTION ENGINE

CROSS-REFERENCE TO RELATED APPLICATION

This application claims priority to British Patent Application No. 1401940.0, filed Feb. 5, 2014, which is incorporated herein by reference in its entirety.

TECHNICAL FIELD

The present disclosure generally relates to an internal combustion engine, for example an internal combustion engine of a vehicle, and more specifically to a timing drive configured to synchronize the rotation of the crankshaft and the camshaft(s) of the internal combustion engine.

BACKGROUND

It is known that an internal combustion engine, such as a Diesel engine or a gasoline engine, generally includes a cylinder block defining at least one cylinder that accommodates a piston coupled to rotate a crankshaft. The cylinder is closed by a cylinder head that cooperates with the piston to define a combustion chamber. A fuel and air mixture is periodically drawn or injected into and ignited in the combustion chamber, thereby resulting in hot exhaust gases whose expansion causes the reciprocating movement of the piston and thus the rotation of the crankshaft.

The fuel is generally provided by at least a fuel injector, which may be located directly into the combustion chamber and which may receive the fuel from a fuel rail in communication with a fuel tank through a fuel pump. The air is usually drawn into the combustion chamber through one or two intake valves, which selectively open and close a communication between the combustion chamber and an intake manifold. Likewise, the exhaust gases are usually discharged from the combustion chamber through one or more exhaust valves, which selectively open and close a communication between the combustion chamber and an exhaust manifold.

The intake and the exhaust valves are conventionally actuated by means of one or more overhead camshafts, which are located over the cylinder head. More specifically, the camshafts may be located directly within the cylinder head or in a Ladder Frame or a Cam Carrier fastened to the cylinder head. Some internal combustion engines, typically the internal combustion engines having only two valves per cylinder (i.e. one intake valve and one exhaust valve), are manufactured according to a Single Over Head Camshaft (SOHC) design, wherein a single camshaft is located over the cylinder head to actuate both the intake valves and the exhaust valves, traditionally via bucket tappets or intermediary rocker arms. Other internal combustion engines, typically the internal combustion engines having four or more valves per cylinder (e.g. at least two intake valves and two exhaust valves), are manufactured according to a Double Over Head Camshaft (DOHC) design, wherein two separated camshafts are located over the cylinder head to actuate the intake valves and the exhaust valves.

Independently from the specific design of the engine, the camshaft(s) are generally rotated by the engine crankshaft through a mechanical transmission, usually referred as timing drive, which synchronizes the rotation of the crankshaft and the camshaft(s), so that the engine valves open and close at proper times during each cylinder's intake and exhaust strokes. By way of example, a typical timing drive for a SOHC includes a first sprocket keyed on the crankshaft, a second sprocket keyed on the camshaft and a chain (or a toothed belt) wound around the first and the second sprocket. A typical timing drive for a DOHC includes the same components of the SOHC system, with the addition of two meshing gears that are individually keyed on a respective of the two camshafts to transmit torque from one another. In other embodiments, the two camshafts may be symmetrically coupled by means of a transmission chain or a transmission belt.

In order to guarantee the operation of the internal combustion engine, it is very important that the speed ratio between the crankshaft and the camshaft(s) is equal to a half, namely that the rotational speed of the crankshaft is two times the rotational speed of the camshaft(s), so that the engine valves open once every two complete rotations of the crankshaft.

To meet this requirement, the standard timing drives delineated above need that the diameter of the second sprocket (i.e. the one keyed on the camshaft) must be double the diameter of the first sprocket (i.e. the one keyed on the crankshaft). As a consequence, the second sprocket is generally a cumbersome component that, being located next to the cylinder head, may have the side effect of increasing the overall height of the internal combustion engine.

Another drawback of the known timing drives is that they are not easily interchangeable. In other words, an internal combustion engine manufactured according to a SOHC design cannot be easily adapted or transformed into an engine implementing a DOHC design and vice versa. In addition, other objects, desirable features and characteristics will become apparent from the subsequent summary and detailed description, and the appended claims, taken in conjunction with the accompanying drawings and this background.

SUMMARY

In accordance with the present disclosure a timing drive for an internal combustion engine is disclosed which eliminates or at least positively reduces the above mentioned drawbacks with a simple, rational and rather inexpensive solution. More specifically, an embodiment of the present disclosure provides an internal combustion engine having a crankshaft located over a crankcase, at least a first camshaft located in a cylinder head, and a timing drive coupling the crankshaft to the first camshaft. The timing drive includes a first mechanical transmission coupling the engine crankshaft to an intermediate shaft located in a cylinder block, and a second mechanical transmission coupling the intermediate shaft to the first camshaft.

As a result, the timing drive is basically split into a primary drive and a secondary drive. The primary drive is represented by the crankshaft, the intermediate shaft and the first mechanical transmission. The secondary drive is represented by the intermediate shaft, the camshaft and the second mechanical transmission. In this way, the speed ratio between the crankshaft and the camshaft is split between the first and the second mechanical transmission, whose components (e.g. sprockets, gears, etc.) may thus be smaller than those of the known timing drives, thereby allowing a reduction of the overall height of the engine.

According to an embodiment of the present disclosure, the engine may include a single camshaft. In other words, the internal combustion engine may be manufactured according to a SOHC design.

As an alternative, the engine may further include a second camshaft located over the cylinder head and a third mechanical transmission coupling together the first and the second camshaft. In other words, the internal combustion engine may be manufactured according to a DOHC design.

It should be observed that the two different embodiments of the present disclosure are easily interchangeable because the engine block including the crankcase, the cylinder block and the primary drive, may be the same for both SOHC and DOHC engines. As a consequence, from a manufacturing point of view, it may be possible to assemble both SOHC and DOHC engines using a single assembly line, where engine blocks of the same kind are selectively assembled to cylinder heads designed for the SOHC or the DOHC configuration. In this way, it may be generally possible to achieve economy scale for purchased parts and avoid proliferation of assembly lines, thereby reducing overall production costs. At the same time, it may be advantageously possible to widen the range of engines belonging to a same family or platform.

According to another aspect of the present disclosure, the first mechanical transmission (between the crankshaft and the intermediate shaft) may include a first sprocket keyed on the crankshaft, a second sprocket keyed on the intermediate shaft and a transmission chain wound around the first and the second sprocket. This aspect of the present disclosure provides a very simple, reliable and cost effective solution to transmit torque between the crankshaft and the intermediate shaft.

According to an alternative aspect of the present disclosure, the first mechanical transmission may include a first toothed pulley keyed on the crankshaft, a second toothed pulley keyed on the intermediate shaft and a transmission belt wound around the first and the second toothed pulley. The use of a toothed belt instead of the chain may have the advantage of reducing the noises generated during the operation of the engine.

According to another alternative aspect of the present disclosure, the first mechanical transmission may include a train of meshing gears. This aspect of the present disclosure has the advantage that the teeth of the gears prevent slipping.

According to another aspect of the present disclosure, the second mechanical transmission (between the intermediate shaft and the camshaft) may include a gear keyed on the camshaft to mesh with another gear keyed on the intermediate shaft. This solution provides an effective and reliable torque transmission between the intermediate shaft and the camshaft. In addition, this solution simplifies the assemblage of the cylinder head on the cylinder block, which may be particularly useful when SOHC and DOHC engines are assembled on the same assembly line.

According to an alternative aspect of the present disclosure, the second mechanical transmission may include a first sprocket keyed on the intermediate shaft, a second sprocket keyed on the camshaft and a transmission chain wound around the first and the second sprocket. This aspect of the present disclosure provides a very simple, reliable and cost effective solution to transmit torque between the intermediate shaft and the camshaft.

According to another alternative aspect of the present disclosure, the second mechanical transmission may include a first toothed pulley keyed on the intermediate shaft, a second toothed pulley keyed on the camshaft and a transmission belt wound around the first and the second toothed pulley. The use of a toothed belt instead of the chain may have the advantage of reducing the noises generated during the operation of the engine.

According to another aspect of the present disclosure, the third mechanical transmission (between the two camshafts, in case of DOHC configuration) includes a gear keyed on the first camshaft to mesh with another gear keyed on the second camshaft. This aspect has the advantages of providing a reliable torque transmission between the two camshafts and of guaranteeing the synchrony of their rotation.

According to an alternative aspect of the present disclosure, the third mechanical transmission may include a first sprocket keyed on the first camshaft, a second sprocket keyed on the second camshaft and a transmission chain wound around the first and the second sprocket. This aspect of the present disclosure provides a very simple, reliable and cost effective solution to transmit torque between the two camshafts.

According to another alternative aspect of the present disclosure, the third mechanical transmission may include a first toothed pulley keyed on the first camshaft, a second toothed pulley keyed on the second camshaft and a transmission belt wound around the first and the second toothed pulley. The use of a toothed belt instead of the chain may have the advantage of reducing the noises generated during the operation of the engine.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the present disclosure or the application and uses of the present disclosure. Furthermore, there is no intention to be bound by any theory presented in the preceding background of the present disclosure or the following detailed description.

Figure 1:
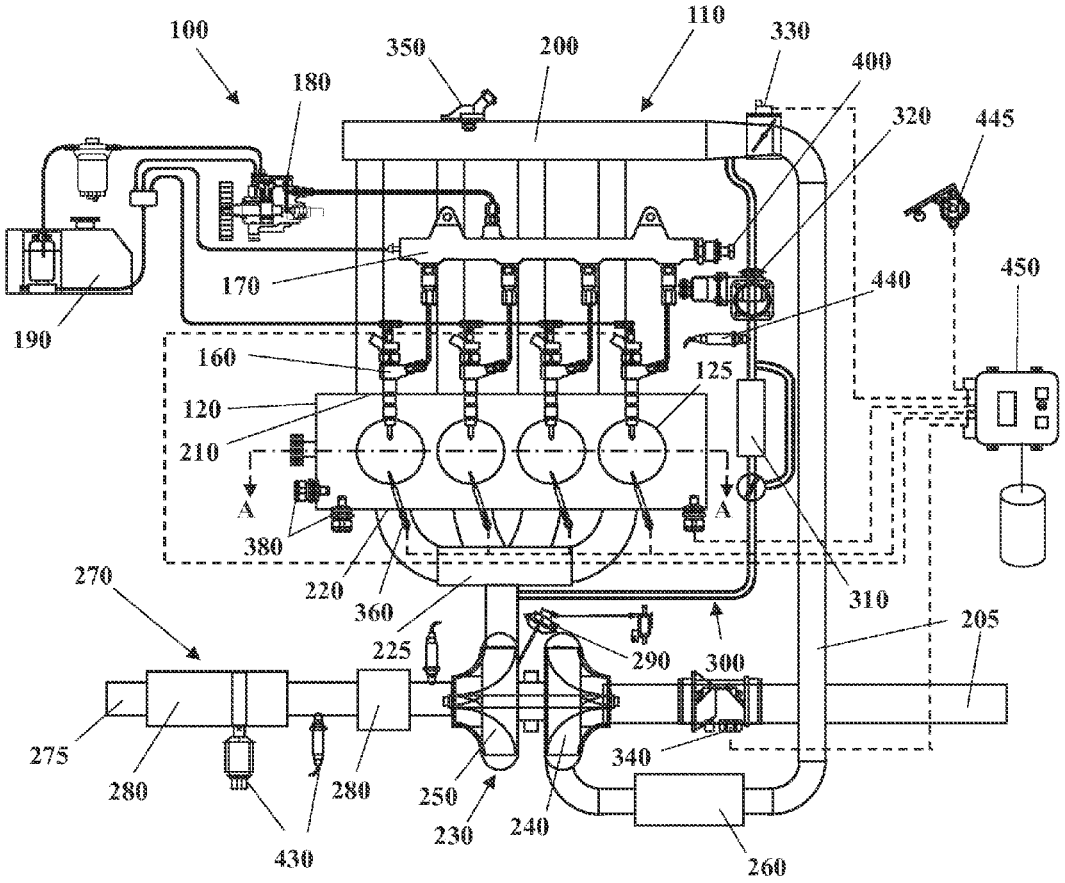
FIG. 1 schematically shows an automotive system.
Figure 2:
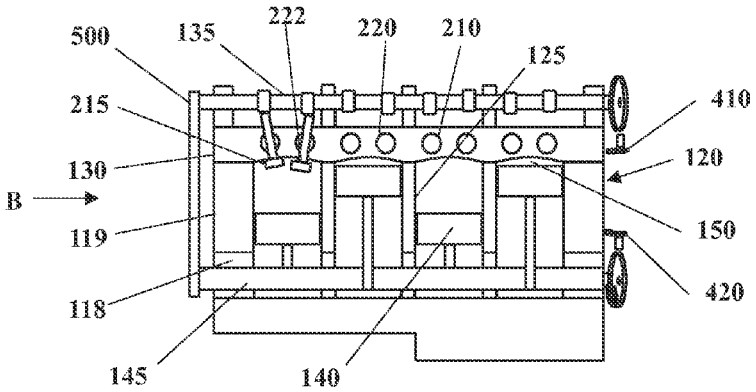
FIG. 2 is the section A-A of FIG. 1.

Some embodiments may include an automotive system 100, as shown in FIGS. 1 and 2, that includes an internal combustion engine (ICE) 110, for example a Diesel engine or a gasoline engine. The ICE 110 includes a crankshaft 145 which is accommodated in, and is supported in rotation by, a crankcase 118. Above the crankcase 118, the ICE 110 further includes a cylinder block 119, which defines at least one cylinder 125 having a piston 140 coupled to rotate the crankshaft 145. In the present example, the cylinder block 119 and the crankcase 118 are manufactured as separated bodies, which are fastened together by proper means. However, other embodiments may provide for the cylinder block 119 and the crankcase 118 to be manufactured as a single body, which is usually referred as engine block and may be indicated with the number 120. The ICE 110 further includes a cylinder head 130, which is located above the cylinder block 119 and cooperates with the piston 140 to define a combustion chamber 150. A fuel and air mixture (not shown) is disposed in the combustion chamber 150 and ignited, resulting in hot expanding exhaust gasses causing reciprocal movement of the piston 140.

The fuel is provided by at least one fuel injector 160 that receives the fuel at high pressure from a fuel rail 170. The fuel rail 170 is in fluid communication with a high pressure fuel pump 180 that increases the pressure of the fuel received from a fuel source or tank 190.

Each of the cylinders 125 has at least one intake port 210 and one exhaust port 220, which are realized in the cylinder head 130. The intake port(s) 210 are provided for convey the air into the combustion chamber 150, whereas the exhaust port 220 are provided for discharge the exhaust gases from the combustion chamber 150. In other embodiments, each cylinder 125 may have more than one intake port 210 and/or more than one exhaust port 220.

The air may be distributed to the intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust system 270 may include an exhaust pipe 275 having one or more exhaust after treatment devices 280. The after treatment devices may be any device configured to change the composition of the exhaust gases. Some examples of after treatment devices 280 include, but are not limited to, catalytic converters (two and three way), oxidation catalysts, lean NOx traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal position sensor 445. Furthermore, the ECU 450 may generate output signals to various control devices that are arranged to control the operation of the ICE 110, including, but not limited to, the fuel injectors 160, the throttle body 330, the EGR Valve 320, the VGT actuator 290, and the cam phaser. Note, dashed lines are used to indicate communication between the ECU 450 and the various sensors and devices, but some are omitted for clarity.

Referring again to the ICE 110, each of the intake ports 210 accommodates an intake valve 215, which selectively allow air into the combustion chamber 150 from the intake port 210 as seen in FIG. 2. Likewise, each of the exhaust port 220 accommodates an exhaust valve 222, which alternately allow exhaust gases to exit through the exhaust port 220. The intake valves 215 and the exhaust valves 222 are actuated by one or more camshafts 135 rotating in time with the crankshaft 145. Each of these camshafts 135 is over the cylinder head 130, so that they are usually referred as overhead camshafts. More specifically, the camshaft(s) 135 may be located directly in, and supported in rotation by, the cylinder head 130. In other embodiments, the camshaft(s) 135 may be alternatively located in, and supported in rotation by, a Ladder Frame or a Cam carrier fastened above the cylinder head 135. In some examples, a cam phaser may selectively vary the timing between the camshaft(s) 135 and the crankshaft 145.

Figures 3, 4, 5:
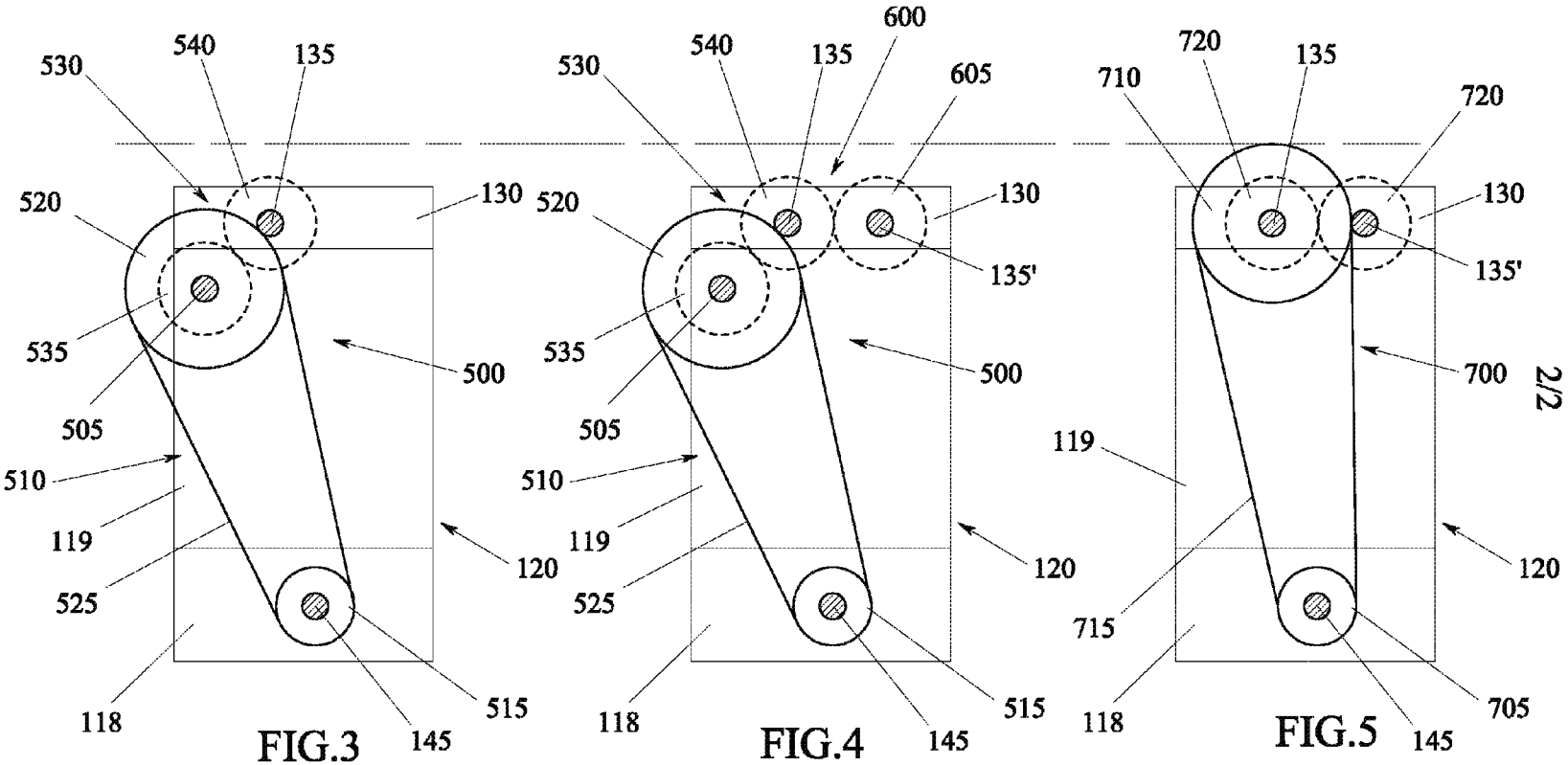
FIG.5 PRIOR ART
FIG. 3 shows schematically the view indicated with the arrow B in FIG. 2.
FIG. 4 is the view of FIG. 3 for a different embodiment.
FIG. 5 is the view of FIG. 3 for a traditional solution.

In greater details, the ICE 110 may be realized according to a Single Over Head Camshaft (SOHC) design, as shown in FIG. 3. This SOHC design provides for the intake valves 215 and the exhaust valves 222 to be actuated by the same camshaft 135, for example via bucket tappets or intermediary rocker arms. The camshaft 135 is mechanically connected to the crankshaft 145 by means of a timing drive, which is globally designed with 500. The timing drive 500 is generally arranged to transmit torque from the crankshaft 145 to the camshaft 135, in such a way that they can rotate in mutual synchrony. In particular, the timing drive 500 should be designed in such a way that the rotational speed of the camshaft 135 is always half the rotational speed of the crankshaft 145.

In the present example, the timing drive 500 particularly includes an intermediate rotating shaft 505, which is parallel to both the crankshaft 145 and the camshaft 135. The intermediate shaft 505 is located in, and supported in rotation by, the cylinder block 119. More specifically, the intermediate shaft 505 may be located in the upper part of the cylinder block 119, above the crankshaft 145 and in proximity of the cylinder head 130 that accommodates the camshaft 135.

The timing drive 500 further includes a first mechanical transmission 510 that connects the crankshaft 145 to the intermediate shaft 505. The first mechanical transmission 510 may be any kinematic mechanisms that transmits torque from the crankshaft 145 to the intermediate shaft 505, in such a way that they can rotate in mutual synchrony. In the present example, the first mechanical transmission 510 includes a first sprocket 515 keyed on the crankshaft 145, a second sprocket 520 keyed on the intermediate shaft 505 and a transmission chain 525, which is wound around the first and the second sprocket 515 and 520 to transmit torque from the crankshaft 145 to the intermediate shaft 505. In other embodiments, the transmission chain 525 may be replaced by a transmission belt, for example a toothed belt, and the first and the second sprockets 515 and 520 may be replaced respectively by a first pulley and a second pulley, for example toothed pulleys. In this way, the first mechanical transmission 510 may become less noisy. In still other embodiments, the first mechanical transmission 510 may include different kinematic mechanisms, for instance a train of gears.

The timing drive 500 further includes a second mechanical transmission 530 that connects the intermediate shaft 505 to the camshaft 135. Also the second mechanical transmission 530 may be any kinematic mechanisms that transmits torque from the intermediate shaft 505 to the camshaft 135, in such a way that they can rotate in mutual synchrony. In the present example, the second mechanical transmission 530 includes a first gear 535 (i.e. a first gear wheel) keyed on the intermediate shaft 505, for example behind the second sprocket (or pulley) 520, whose teeth mesh with the teeth of a second gear 540 (i.e. a second gear wheel) keyed on the camshaft 135. This solution provides a simple, effective and reliable torque transmission between the intermediate shaft 505 and the camshaft 135. However, in other embodiments, the second mechanical transmission 530 may include different kinematic mechanism, for instance a chain or belt transmission.

Turning now to FIG. 4, the ICE 110 may be alternatively realized according to a Double Over Head Camshaft (DOHC) design. This DOHC design provides for the intake valves 215 and the exhaust valves 222 to be actuated by two separated camshafts, respectively a first camshaft 135 and a second camshaft 135'. These two camshafts 135 and 135' are parallel one another and are both located in the cylinder head 130. One of these two camshafts, for example the first camshaft 135, may be mechanically connected to the crankshaft 145 by means of the timing drive 500, which has been already described above with reference to the SOHC design. As a consequence, all the specific examples and alternatives disclosed in that context should be considered applicable also in this present case.

In addition to that, the two camshafts 135 and 135' are mutually connected by a third mechanical transmission 600. The third mechanical transmission 600 may be any kinematic mechanisms that transmits torque from the first camshaft 135 to the second camshaft 135', in such a way that they can rotate in mutual synchrony. In particular, the mechanical transmission 600 should be designed in such a way that the rotational speed of the two camshafts 135 and 135' is always the same, so that they both rotate at half the rotational speed of the crankshaft 145. In the present example, the third mechanical transmission 600 includes a third gear 605 (i.e. a third gear wheel) keyed on the second camshaft 135', whose teeth mesh with the teeth of the second gear 540 that is keyed on the first camshaft 135. As an alternative, the teeth of the third gear 605 may mesh with the teeth of a fourth gear (i.e. a fourth gear wheel) keyed on the first camshaft 135 but separated from the second gear 540, for example located ahead or behind it. In still other embodiments, the third mechanical transmission 600 may include a different kinematic mechanisms, for instance a chain or belt transmission that connects the two camshafts 135 and 135'.

In view of what has been described, it follows that the SOHC and DOHC versions of the ICE 110 may share the very same engine block 120, along with all the components located therein, including the timing drive 500. As a consequence, it is advantageously possible to manufacture SOHC or DOHC engines by simply changing the cylinder head 130 to be assembled on the cylinder block 119. Therefore, a single assembly line may be arranged to manufacture SOHC engines or DOHC engines, thereby achieving economy scale for purchased parts and reducing overall production costs. At the same time, it may be advantageously possible to provide a comprehensive range of engines having different power but belonging to a same family or platform.

Another advantage of the solutions described in this disclosure is that of allowing a reduction of the overall height of the ICE 110. This advantage can be appreciated by comparing FIGS. 3 and 4 with FIG. 5, which shows a traditional timing drive 700 of a DOHC engine (but the same would apply also for a SOHC engine). The traditional timing drive 700 basically includes a first sprocket 705 keyed on the crankshaft 145, a second sprocket 710 keyed on a first camshafts 135 and a chain or toothed belt 715 wound around the first and the second sprocket 705 and 710; two meshing gears 720 being keyed on the first and the second camshaft 135 and 135' to transmit torque from one another. Since the rotational speed of the camshafts 135 and 135' must be half the rotational speed of the crankshaft 145, it follows that the traditional timing drive 700 requires that the diameter of the second sprocket 710 is double the diameter of the first sprocket 705. Being placed next to the cylinder head 130, the second sprocket 710 generally increases the overall height of the ICE 110. On the contrary, the second sprockets 520 shown in FIGS. 3 and 4 are located next to the cylinder block 119, so that they have a lower impact on the overall height of the ICE 110.

Another advantage of the solutions shown in FIGS. 3 and 4 is that the overall speed ratio between the crankshaft 145 and the camshaft(s) 135 may be split between the first and second mechanical transmission 510 and 530, so that the dimensions of their components (e.g. sprockets and gears) can be chosen and varied on the basis of specific packaging requirements.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents.

What is claimed is:

1. An internal combustion engine comprising:

a crankshaft located in a crankcase;

a first camshaft located over a cylinder head, and a timing drive coupling the crankshaft to the first camshaft, the timing drive including a first mechanical transmission coupling the engine crankshaft to an intermediate shaft rotatably supported in a cylinder block interposed between the crankcase and the cylinder head, and a second mechanical transmission coupling the intermediate shaft to the first camshaft.

2. The internal combustion engine according to claim 1, wherein the first mechanical transmission comprises a first sprocket keyed on the crankshaft, a second sprocket keyed on the intermediate shaft and a transmission chain rotatably coupling the first sprocket and the second sprocket.

3. The internal combustion engine according to claim 1, wherein the first mechanical transmission comprises a train of meshing gears.

4. The internal combustion engine according to claim 1, wherein the second mechanical transmission comprises a first sprocket keyed on the intermediate shaft, a second sprocket keyed on the camshaft and a transmission chain rotatably coupling the first sprocket and the second sprocket.

5. The internal combustion engine according to claim 1, wherein the second mechanical transmission comprises a first toothed pulley keyed on the intermediate shaft, a second toothed pulley keyed on the camshaft and a transmission belt rotatably coupling the first toothed pulley and the second toothed pulley.

6. The internal combustion engine according to claim 1 further comprising a second camshaft located over the cylinder head and a third mechanical transmission rotatably coupling the first camshaft and the second camshaft.

7. The internal combustion engine according to claim 6, wherein the second mechanical coupling rotatably couples the first mechanical coupling and the third mechanical coupling.

8. The internal combustion engine according to claim 6, wherein the third mechanical transmission comprises a first gear keyed on the first camshaft and a second gear keyed on the second camshaft and in meshing engagement with the first gear to rotatably couple the first gear and second gear.

9. The internal combustion engine according to claim 8, wherein the first gear keyed on the first camshaft meshes with both the second gear keyed on the second camshaft and the second mechanical coupling.

10. The internal combustion engine according to claim 6, wherein the third mechanical transmission comprises a first sprocket keyed on the first camshaft, a second sprocket keyed on the second camshaft and a transmission chain rotatably coupling the first sprocket and the second sprocket.

11. The internal combustion engine according to claim 6, wherein the third mechanical transmission comprises a first toothed pulley keyed on the first camshaft, a second toothed pulley keyed on the second camshaft and a transmission belt rotatably the first and the second toothed pulley.

12. The internal combustion engine according to claim 1 wherein a rotational axis of the intermediate shaft is parallel to a rotational axis of the crankshaft and a rotational axis of the camshaft.

13. The internal combustion engine according to claim 12 wherein the axis of the intermediate shaft is located in an upper part of the cylinder block above the axis of the crankshaft and below the axis of the camshaft.

14. The internal combustion engine according to claim 13 wherein the axis of the intermediate shaft is located outboard from the axis of the camshaft relative to a centerline of the cylinder block.

15. The internal combustion engine according to claim 12 wherein the first mechanical transmission is located below an upper surface defined by the cylinder head.

16. The internal combustion engine according to claim 1 wherein the first mechanical transmission has a first rotational speed ratio and the second mechanical transmission has a second rotational speed ratio, wherein the first and second rotational speed ratios combine to provide an overall rotational speed ratio of 2:1 between the crankshaft and the first camshaft.

17. The internal combustion engine according to claim 16 wherein the first rotational speed ratio is not less than 1:1 and the second rotational speed ratio is not greater than 1:1.

18. The internal combustion engine according to claim 17, wherein the first mechanical transmission comprises a first toothed pulley keyed on the crankshaft, a second toothed pulley keyed on the intermediate shaft and a transmission belt rotatably coupling the first toothed pulley and the second toothed pulley.

19. An internal combustion engine comprising:

a crankshaft located in a crankcase;

a first camshaft located over a cylinder head;

a timing drive coupling the crankshaft to the first camshaft, the timing drive including a first mechanical transmission coupling the engine crankshaft to an intermediate shaft rotatably supported in a cylinder block interposed between the crankcase and the cylinder head; and a second mechanical transmission having a first gear keyed on the camshaft and a second gear keyed on the intermediate shaft in meshing engagement with the first gear to rotatably couple the camshaft and the intermediate shaft.

* * * * *